United States Patent [19]

Smith et al.

[11] 4,205,848

[45] Jun. 3, 1980

[54] AERIAL GUNNERY TARGET

[75] Inventors: David H. Smith; John S. Yates, both of Fountain Valley; Paul C. Kochendorfer, Laguna Niguel, all of Calif.

[73] Assignee: Prototype Development Associates, Inc., Santa Ana, Calif.

[21] Appl. No.: 894,924

[22] Filed: Apr. 10, 1978

[51] Int. Cl.[2] ..... B64D 3/02

[52] U.S. Cl. ..... 273/361

[58] Field of Search ..... 273/105.3, 181 E, 184 R, 273/185 R, 102 B; 40/215

[56] References Cited

U.S. PATENT DOCUMENTS

| | | | |
|---|---|---|---|
| 1,837,627 | 12/1931 | Mead et al. | 273/102 B |
| 2,342,651 | 2/1944 | Dircksen | 273/105.3 |
| 2,667,351 | 1/1954 | McKinney | 273/105.3 |
| 2,807,287 | 9/1957 | Frey | 273/105.3 X |
| 3,000,634 | 9/1961 | South | 273/105.3 |
| 3,072,410 | 1/1963 | Simjian | 273/181 E X |

FOREIGN PATENT DOCUMENTS

| | | | |
|---|---|---|---|
| 496230 | 7/1919 | France | 273/105.3 |

*Primary Examiner*—George J. Marlo
*Attorney, Agent, or Firm*—George F. Bethel; Patience K. Bethel

[57] ABSTRACT

The following specification discloses an aerial gunnery target that is adapted to be towed by an aircraft at high speeds for gunnery training and aircraft weapons qualifications. The assembly comprises a multiplicity of strands or cords such as twisted and plyed polypropylene lines. Each of said strands is secured at the forward end on a towing frame having various configurations which include circles, bars, radial extensions, and other configurations, including hexagons and triangles. The towing frame is pulled by means of a conventional towing cable and may have arms that extend outwardly upon deployment by aerodynamic forces, or may be rigidly constructed in the desired shape. The elongated multiplicity of cords extend backwardly from the frame to a terminal point, such as an analogous frame or a confluence point, such as a ring, where they are attached in coupled relationship, or any other terminal means for securing the ends of the elongated cord elements. The elongated cord elements avoid the coupling of vibratory motion from one cord element to another which results in the oscillatory flapping of targets constructed of conventional fabric. The cords are provided in an array such that they do not create aerodynamic lift and fluttering when being towed. They further prevent the erratic flight that is frequently encountered in conventional rigid targets when they are damaged by gun fire. The multiplicity of elongated cord elements provide a visual surface that appears to be continuous at a distance for target purposes. It also provides a target capable of taking substantial hits without being destroyed, due to the loose configuration of the strands or cords.

20 Claims, 18 Drawing Figures

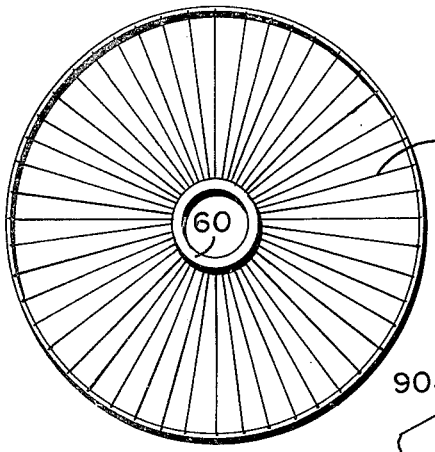
FIG. 11
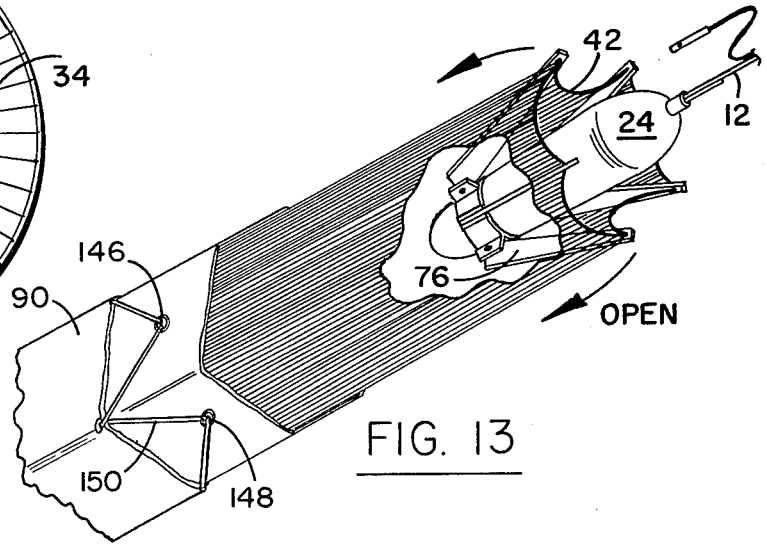
FIG. 13
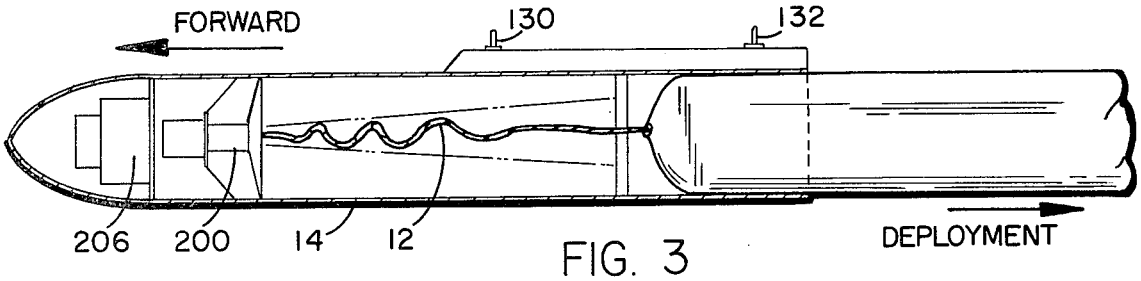
FIG. 3
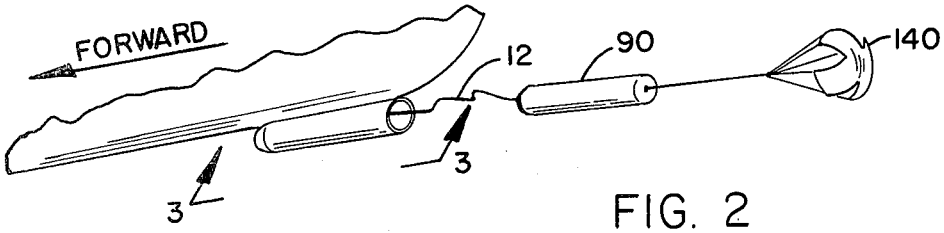
FIG. 2
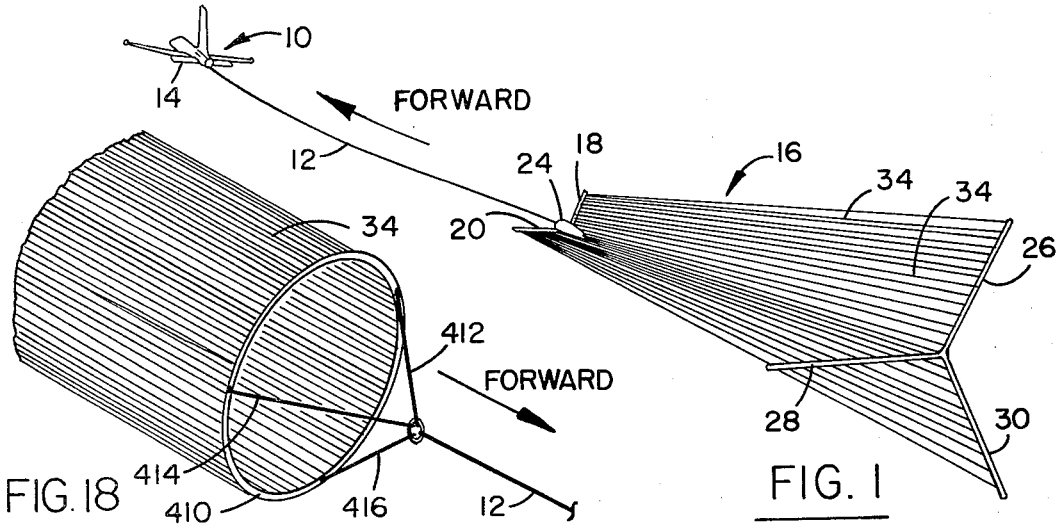
FIG. 18
FIG. 1

FIG. 5
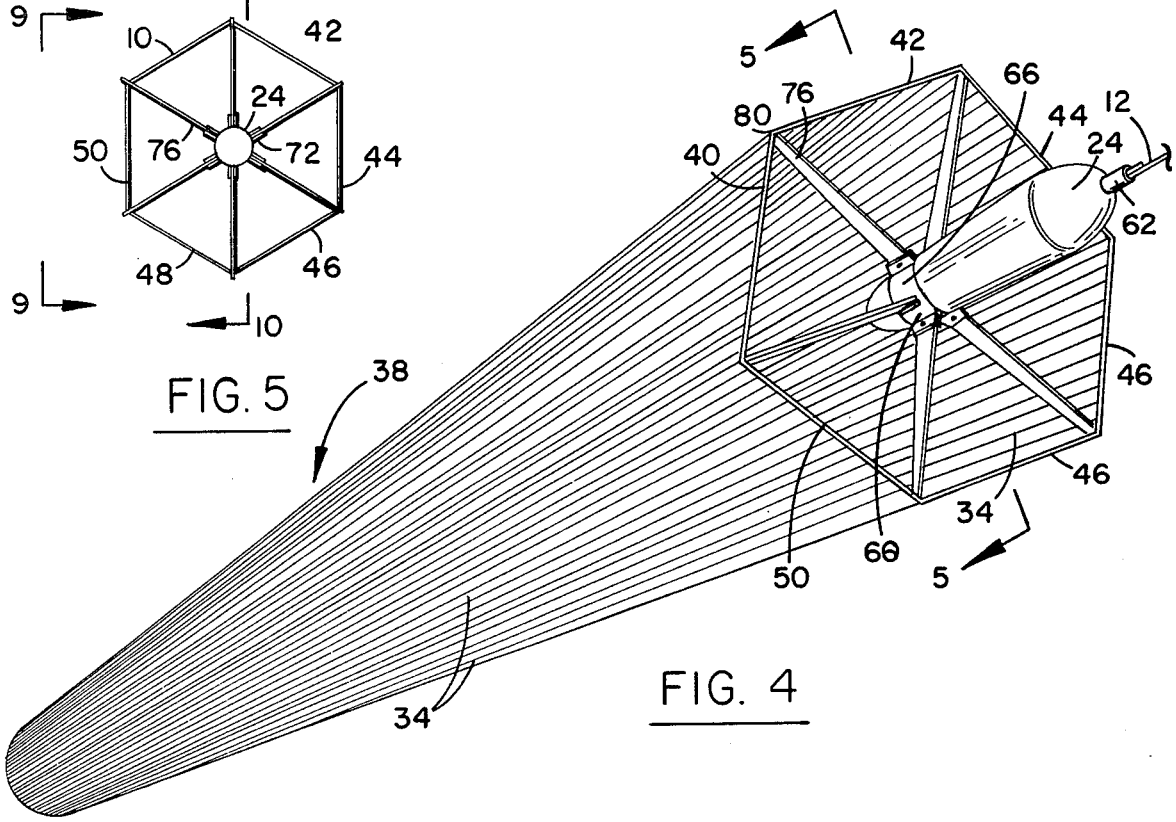
FIG. 4
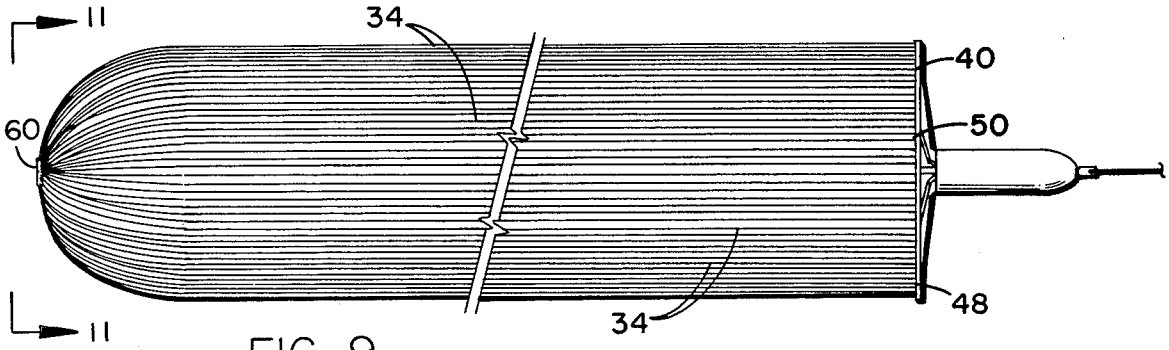
FIG. 9
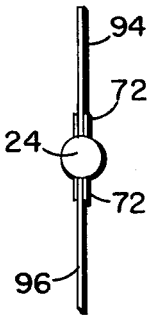
FIG. 6
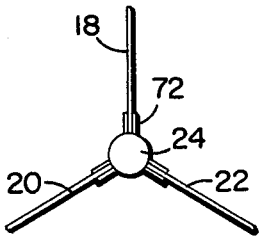
FIG. 7
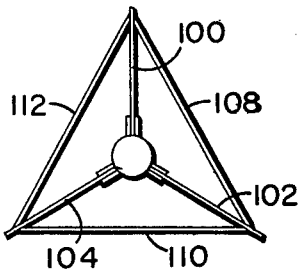
FIG. 8

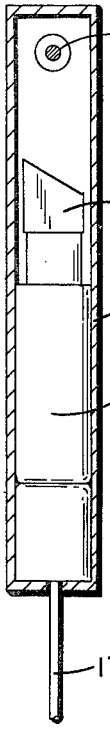
FIG. 15
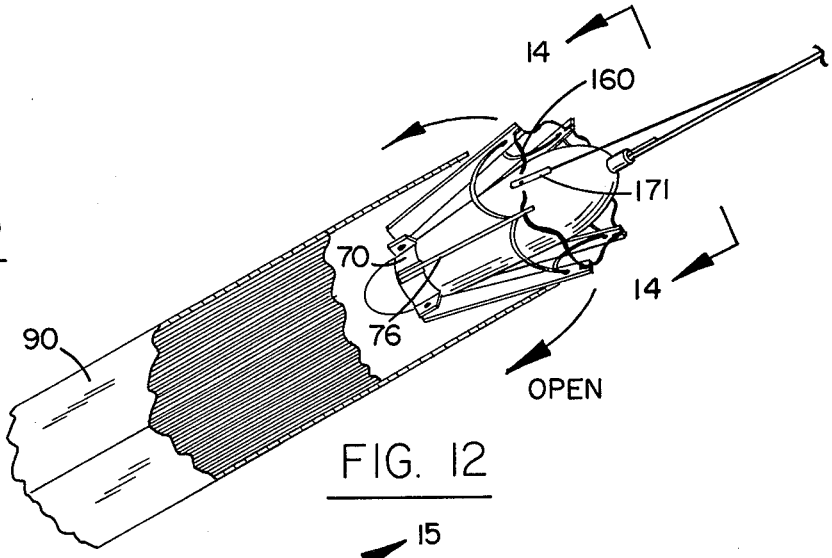
FIG. 12
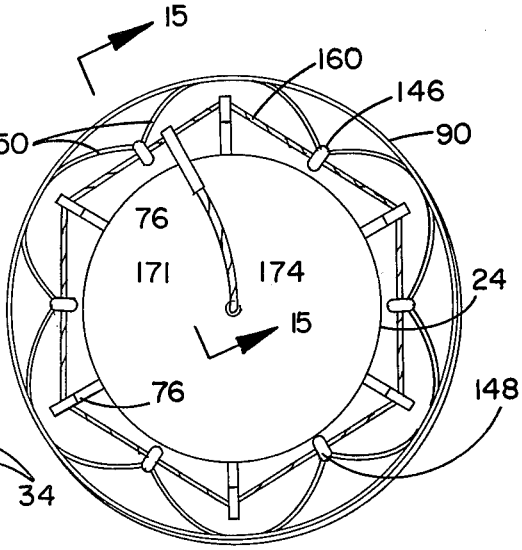
FIG. 14
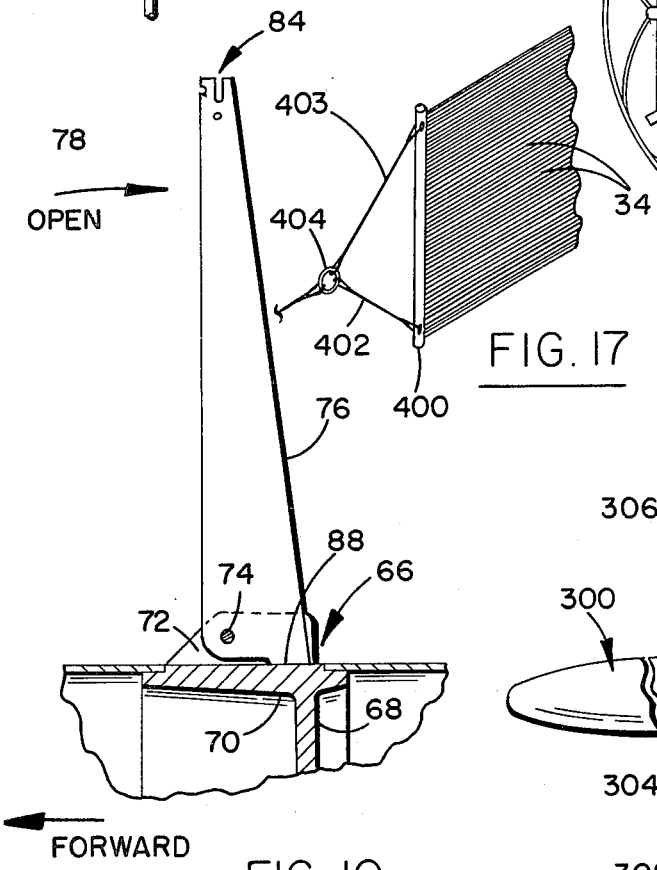
FIG. 17
FIG. 10
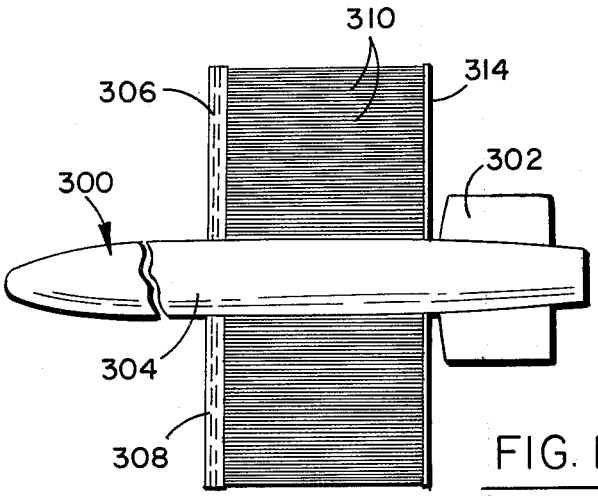
FIG. 16

AERIAL GUNNERY TARGET

BACKGROUND OF THE INVENTION

1. FIELD OF THE INVENTION

The field of this invention lies within the target and gunnery art. In particular, it lies within the specific field of aerial targets that are towed by an aircraft.

2. DESCRIPTION OF THE PRIOR ART

The prior art related to aerial gunnery targets has included those targets such as those disclosed in U.S. Pat. Nos. 2,342,651, 3,000,634, as well as other related patents that describe elongated cylindrical sleeves. In addition thereto, flat targets made from lightweight cloth have also been used and described in the prior art. The foregoing targets are generally unsatisfactory when towed at air speeds above two hundred knots. As is well known, present day aircraft activity takes place at substantially higher speeds. As a consequence, targets used for aircraft and anti-aircraft gunnery training to be effective should be capable of being towed at such speeds.

The prior art sleeves and banners that are towed have serious limitations when towed at high speeds due to the fact that they tend to flutter with increasing intensity as air speed increases. As a consequence, at certain speeds above three hundred knots, the typical banner type target will be destroyed by rapidly oscillating movement, or flapping. This is due to two reasons. First, the foregoing types of targets have a standard warp and fill thread arrangement as is common in the textile art. Thus, a vibratory mode between one elongated strand that would normally be the warp is communicated to another elongated strand through the fill threads joining them. As a consequence, the vibratory modes are transmitted between fibers. Second, when the closely woven materials that are known in the common textile art, regardless of how open the weave is, are disturbed, any region of the fabric that is not parallel to the air flow will provide an air foil type of effect, giving aerodynamic lift that will amplify the disturbance.

The invention disclosed herein provides for the elimination of transmitted forces between adjacent warp strands by substantially eliminating connecting threads or fibers such as fill fibers or other connecting elements. The target also eliminates the general characteristics of an air foil by creating small elongated strands that are roughly circular in cross section in order to minimize their lift when disturbed. As a consequence, the lift and transmittal of forces between adjacent members is greatly reduced.

The foregoing reduction of transmitted forces in adjacent members and of air foil characteristics allows the target to be towed at substantial speeds. There have been wind tunnel tests that indicate that the target of this invention can be towed at speeds commensurate with all types of high performance aircraft. As a consequence, this invention should be read broadly as a substantial step over the prior art in light of the following claims and the description of the preferred embodiments hereinafter.

SUMMARY OF THE INVENTION

In summation, this invention comprises a high speed aerial target formed from a multiplicity of elongated strands that are held by a forward towing frame and connected at the aft end.

More specifically, the invention incorporates the utilization of a towing frame that is attached to a towing cable that can be towed by a manned or unmanned aircraft. The towing frame has a multiplicity of elongated strands such as polypropylene cord or rope attached thereto. The cords or ropes are fastened to the frame by means of any suitable termination, such as a chemical bond, or textile or metallic joining means. The configuration of the frame in flight can be in the form of a straight bar, a circular member, a hexagonal member, a triangular member, or a member having radial struts extending from a central hub.

Many of the foregoing configurations substantially rely upon the frame being deployed from a central portion usually including a pod that receives information as to projectiles passing in proximity thereto for scoring purposes. Prior to deployment, the entire structure can be collapsed and placed in a bag within a metal container attached to the fuselage of an aircraft with appropriate deployment means, such as a pilot chute and release means.

Other configurations rely upon rigid frames such as straight bars, circles, hexagons, and members having radial arms permanently affixed to a central hub.

The general concept of the multiplicity of cords or strands that form the appearance of an optically completed form at a distance is unique. More importantly, they eliminate the transmission of adjacent forces between elements and minimize flapping so that high speed towing can take place. This is a substantial step in the art as will be described in the preferred embodiments and as claimed hereinafter.

DESCRIPTION OF THE DRAWINGS

The invention will be more clearly understood by reference to the description below taken in conjunction with the accompanying drawings wherein:

FIG. 1 shows a target of this invention being towed by an aircraft wherein the frame has been formed as one having three radially extending arms;

FIG. 2 shows a view of the deployment of the target after the bag in which the target is packed has been pulled from its container;

FIG. 3 shows a sectional view of the target in the direction of lines 3—3 as the bag in which the target is packed is being pulled from its container;

FIG. 4 shows an alternative target having a hexagonal configuration provided by six radially extending arms;

FIG. 5 shows a view of the frame looking toward the forward portion of the target shown in FIG. 4 in the direction of lines 5—5 thereof;

FIG. 6 shows a front view of an alternative embodiment of a towing frame to form the appearance of a panel or banner;

FIG. 7 shows a front view of the towing frame of the target as seen in FIG. 1;

FIG. 8 shows an alternative triangular towing frame as seen from the forward portion thereof;

FIG. 9 shows a fragmented side view as seen in the direction of lines 9—9 of FIG. 5;

FIG. 10 shows the arms of the towing frame in their deployed and open condition as seen in the direction of lines 10—10 of FIG. 5;

FIG. 11 shows a rear view of the target as brought together in a circular form in the direction of lines 11—11 of FIG. 9;

FIG. 12 shows a fragmented and partially sectioned view of the target at the instant that the cutter severs the securement cord.

FIG. 13 shows the target being further deployed from the position of FIG. 12 as the bag in which the target is packed is pulled off the target by the aerodynamic force of the pilot chute;

FIG. 14 shows an end view at the forward section of the target system prior to being deployed and while it is still in its container;

FIG. 15 shows a sectional view of the cutter of this invention utilized to cut the securement cord for deploying the target as generally seen in the direction of lines 14—14 of FIG. 12;

FIG. 16 shows an alternative embodiment of the invention as seen downwardly upon a drone or rigid target having enhanced wing members for providing greater optical acquisition of a drone or target of the type shown therein;

FIG. 17 shows an embodiment of the invention in which the frame is a rigid bar to form the appearance of a panel or banner; and, FIG. 18 shows an embodiment of the invention in which the frame is a rigid circular ring to form the appearance of a cylinder or sleeve.

DESCRIPTION OF THE PREFERRED EMBODIMENTS

Looking particularly at FIGS. 1, 4, 5 through 9, and 17 and 18, it can be seen that a number of various embodiments have been shown of a basic target. All of the foregoing targets comprise a plurality of cords or strands that pass from a towing bar or frame backwardly to a rearward portion. The forward end is constructed of a number of different configurations depending upon the type of target, the speed, the overall characteristics that are to be employed during target practice, as well as the type of aircraft that is to tow the target.

As a consequence of the foregoing, a general description as it relates to the targets described and seen more particularly in FIGS. 4, 5 and 9, shall be enunciated initially due to its commonality with the remaining targets as well as that of FIG. 1.

In looking at FIG. 1, it can be seen that an aircraft 10 is shown having a tow line 12 emanating from a capsule, container or housing 14. The tow line 12 is attached to a tri-radially oriented target 16 having a forward portion comprising three arms 18, 20 and 22 that can be seen more specifically in FIG. 7. The three arms are joined at the interior portion by a radar capsule 24. The radar capsule 24 encapsulates a doppler radar system for purposes of providing scoring when projectiles pass within a certain prescribed volume around the target.

The foregoing target terminates in three members 26, 28 and 30 that can be formed of any suitable material even to the extent of being flexible, textile bands. Between the forward portion comprising arms 18 through 22 and the rearward members 26 through 30 are a number of cords 34. The cords are formed of a polypropylene fiber that has been twisted and plied from polypropylene filaments. The filaments are generally continuous and are formed in the art by being drawn from a spinneret on a continuum.

Suffice it to say, the cords or strands 34 should be of substantial strength to allow for high speeds and the attendant drag imposed upon them.

The lines, strands, or cords 34 can be obtained by purchasing cords provided by the Pacific Fiber and Rope Company of Wilmington, California. However, any particular type of cords, ropes, or filaments that are freely movable can be utilized for the invention.

Looking more particularly at FIGS. 4, 5 and 9, it can be seen that a second embodiment of a target 38 has been shown. The target 38 comprises a number of the strands or cords 34 as previously described and forms a conformation similar to a sleeve. The cords are looped and attached by any suitable means to a hexagonal frame comprising frame members 40, 42, 44, 46, 48, and 50.

The cords 34 have been secured together by means of a ring 60 at the aft end. Each cord is looped or secured to the frame members 40 through 50 or the ring 60 by being looped thereover, tied in place, secured by means of a metal clamp, grommet, or by any other suitable means known to both the textile trade or the metal fabrication art.

The target shown in FIGS. 4, 5 and 9, has the same radar scoring device 24 as shown in FIG. 1. Attached to the radar scoring device is a tow line fixture 62 having the tow line 12 attached thereto. The radar scoring device is attached to the central hub 66 to which the arms are also attached as shown in FIG. 10. The hub members 66 have an interior web 68 and a peripheral member 70.

Attached to the peripheral member 70 are a set of upstanding brackets 72 having pins 74 passing therethrough. Each one of the brackets 72 with the pin 74 passing therethrough supports an arm 76 that comprises the arms that are joined to the apex of each frame member 40 through 50.

The arms 76 are pivotally oriented so that when they are pushed in the direction of arrow 78, they will open by virtue of drag or air forces being imposed against the cords 34 of the target. The arms 76 are in turn connected to the apexes of the frame members 40 through 50, such as at point 80 by means of a slot, pin configuration or keyway, such as that shown at the terminal end 84 of arms 76. At the other end of arms 76, a stop 88 is shown against which the arm rests in its opened condition. In other words, the arm cannot move any further on its pintal point, provided by pin 74 beyond the stop 88 once it is opened.

The foregoing target configuration serves to eliminate oscillatory and vibratory modes established between the cords or strands 34 due to the fact that they are not interconnected substantially between the forward and rear ends.

More importantly, the members, as can be seen, are all singular in nature and like any open surface, cannot provide substantial lift. The reduction of lift prevents an airfoil effect that generally causes a banner of the known art to vibrate and oscillate to its detriment and untimely destruction.

In greater detail, the target shown in FIGS. 4, 5 and 9 comprises a tubular arrangement of the cords attached to a forward support structure, such as the towing frame, shown in FIG. 5. The tubular body has six panels, wherein each is made up of forty polypropylene continuous filament cords approximately one quarter inch in diameter and twenty five feet long. The cords are stitched to nylon reinforced vinyl headings in the form of the webs 40 through 50. However, these webs as previously stated, can be made of any suitable material, such as a metal brace configuration or other elements, attached to the arm attachment means 84.

The aft end or rear end of the target may be narrower than the forward end. It has been noted that wind tunnel tests have shown that embodiments for which the aft end is either larger or smaller than the forward end, are more stable than embodiments having equal forward and aft diameters.

The forward ends with the webs 40 through 50 are provided with a casing through which support cables are threaded that join the six panels at the ends of the arms at points 84 to form the target body. However, other means as previously stated can be used to form the webs 40 through 50 around the ends of the arms as extended.

The showing of FIG. 11 is of the target in its towed condition as it is billowed out. However, prior to deployment, the target is generally formed into a rough twisted state and packed into a bag, such as bag 90. The bag 90 confines the target which is later deployed through a system that will be described.

Looking more particularly at FIG. 6, a target having two panels is shown wherein two arms 94 and 96 are connected to a doppler type radar capsule 24 that provides the scoring as previously described. The tow arms 94 and 96 are supported by the bracket 72 on either side as described in FIG. 10. In the embodiment of FIG. 6 a number of cords 34 stream out from the rear of the arms 94 and 96 backwardly and provide the appearance of a singular panel or banner. The end of the banner is secured by either a metallic member or a fabric strip.

When the foregoing banner is deployed, it streams backwardly and substantially eliminates the whipping and movement that is common to a prior art banner. Thus, it has a tendency to outlast the banners that are known in the art that generally have an untimely destructive cycle.

The embodiment as shown in FIG. 7 is analogous to the embodiment of FIG. 1 wherein the arms 18, 20 and 22 expand outwardly from the capsule 24. In all other matters, the arms 76 are analogous to those arms labeled 18, 20 and 22. In addition thereto, the bracket members 72 are utilized to support the arms with the other attendant attachment means of FIG. 10.

FIG. 8 shows a triangular member having arms 100, 102 and 104 which are analogous to arms 76. They extend outwardly to provide three panels, namely panels 108, 110 and 112 that are connected to the ends of the arms in a manner analogous to the webs 40 through 50.

The target as previously stated, is packed within a bag, such as bag 90. The deployment bag 90 is installed in a cylindrical cannister or nacelle such as that shown with the aircraft 10 and has been labeled 14. The container is attached to the bottom of the aircraft by means of such simple methods as two lugs 130 and 132.

The target when it is packed in the deployment bag 90 is folded in the entirety and implaced within the cylindrical cannister 14. The target deployment and flight sequence is initiated by allowing the aft cover of the cannister to be released and blown away. The release mechanism can be in any suitable form such as an explosive release, a spring loaded release, or a solenoid actuated means or other mechanical or electromechanical means.

As the aft cover is blown away, it pulls out a pilot chute 140 as seen in FIG. 2. The pilot chute opens and pulls the packed target deployment bag 90 out of the cannister 14.

When the target is packed, it has a number of eyelets, such as eyelets 146 and 148 with a cord 160 passing therethrough. This can be seen in greater detail as cord 160 in FIG. 14. The cord 160 serves to enclose the bag 90 around the target and to restrain the arms from opening, and is controlled by a reefing line cutter.

The reefing line cutter function is operated by a lazy line attached to the tow line. As tension is applied to the tow line, the lazy line will activate the reefing line cutter to cut the bag 90 loose, as well as to allow for deployment of the arms 76.

The arms 76 when packed are in a collapsed position in the opposite direction from arrow 78 as shown in FIG. 10. These are collapsed and held by way of a line 160 that passes therethrough or around the arms 76 and holds them in a collapsed condition. The arms can be looped with the line 160 passing therethrough or formed with D rings or other eyelets and means for receiving the line 160. Suffice it to say, the line 160 as shown in FIG. 14 is in its packed condition so that the bag and the arms 76 are held in position thereby.

After extraction from the cannister 14, the arms 76 are allowed to open by the reefing cutter shown in FIG. 15 by means of a knife 170 slicing the cord 160 by a firing charge 172 that is fired by the lazy line 174 that has been placed in tension. The reefing cutter 171 as shown in the figures, can be substituted by any other suitable means in order to deploy the arms, such as a lazy line tension cutter, or other elements that are known in the art.

The showings of FIGS. 12 and 13 show a cutting by the reefing cutter 171 progressing whereby it has cut the line 160 so that the arms 76 are about to open. In FIG. 13, the arms are substantially opening and will open fully shortly thereafter. In the final stage of deployment, the arms, of course, are extended in the open condition as shown in FIG. 10.

The foregoing deployment operation can function in any suitable manner, so long as the target is pulled outwardly of the bag, such as bag 90 and the cannister 14. However, it is felt that the foregoing means for deployment are substantially effective with today's state of the art aircraft and towing techniques.

An extended target profile is shown in FIG. 16 wherein a drone 300 with a tail section 302 and a fuselage 304 are shown with arms 306 and 308 on either side. The arms 306 and 308 may deploy similarly to the arms 76 as previously described, or they may be fixed in position. However, instead of the arms 306 and 308 having webs or members such as 42 and 44 therebetween, they have a direct connected series of cords 310 that are analogous to the cords 34 that have been described hereinbefore. The cords 210 terminate at a metal member or fabric material 314 aft of the arms 306 and 308. In this manner, the cords 310 stream backwardly in the manner of the cords 34 and provide an enhanced optical target for greater viewing purposes and realism during aerial gunnery activity.

Again, the radar and scoring system such as in the pod 24 is a matter of choice in the drone 300. Regardless of the type of scoring means, it should be understood that the target employs the elongated cord-like members as previously described in order to provide for superior optical acquisition purposes.

FIG. 17 shows a banner comprising cords 34 attached to a tow bar 400 similar to the other towing frames.

However, in this case, it is a rigid member that does not fold. A bridle comprising wires 402 and 403 connected to an eyelet 404 is used for towing the banner.

FIG. 18 shows a circular hoop 410 from which cords 34 stream back. The hoop can be towed by bridle members 412, 414 and 416 which nest in an apex connected to the towing cable 12.

The foregoing showings of FIGS. 17 and 18 do not utilize folding arms, but conform to the shape in which they are towed.

From the foregoing, it can be seen that this invention can be a substantial step over the prior art. In particular, it is thought that this target provides for numerous advantages over the prior art by means of creating greater survivability to withstand projectile hits as well as reducing aerodynamic loads, without degradation at higher air speeds. This is due, as previously stated, to the lack of structural members being joined to each other by virtue of the individual structural and independent nature of the target elements, as well as avoiding the air foil characteristics of prior art fabric banners and sleeves.

In addition to the foregoing features, when a projectile hits the target, such as a small shell, it does not adversely affect the drag and stability of the target and in some measure can pass through the target and possibly only adversely affect a small number of cords that it hits.

Of course, the target can be pulled in singular and plural form and constitutes a number of various configurations utilizing the inherent characteristics of the cords or streamers in multiple relationship to each other, attached to a towing frame of any particular geometric choosing. As a consequence, this invention should be read broadly in light of the following claims when viewed with the prior art.

We claim:

1. An aerial gunnery target that is towed behind an aircraft comprising:

a towing frame defining a structure having at least one member outside of its central axis adapted for attachment to a cable that is towed behind an aircraft; and, a plurality of elongated non-woven strand members attached to and extending from said towing frame structure forming a substantially pre-established outline having a cross section substantially conforming to the structure to which they are attached when said target is towed at speeds compatible with said towing aircraft and said strands stream back from said towing frame.

2. The target as claimed in claim 1 wherein:

said frame has said strand members attached thereto in the form of elongated cords; and wherein, said elongated cords terminate in attached relationship at the end distal from said towing frame.

3. The aerial target as claimed in claim 2 further comprising:

a scoring device for indicating the proximity of a projectile passing in relationship thereto attached to said towing frame.

4. The aerial gunnery target as claimed in claim 3 wherein said frame comprises:

two members diametrically opposed to each other forming said frame to provide a banner with said cords substantially in the same planar relationship; and wherein, said arms extend from said scoring device.

5. The aerial gunnery target as claimed in claim 3 wherein said towing frame comprises:

at least three arms radially extending from said scoring device formed as a radar pod.

6. The aerial gunnery target as claimed in claim 5 wherein:

said radially extending arms at their terminal points are interconnected by members extending therebetween; and, said plurality of cords are attached to said members extending between the ends of said arms.

7. The aerial gunnery target as claimed in claim 6 wherein said members extending between said arms comprise:

a flexible metal cable.

8. The aerial gunnery target as claimed in claim 7 wherein:

said arms can be folded from their radially extended relationship to lie substantially axially in the same direction as the axis of said radar pod.

9. The aerial gunnery target as claimed in claim 8 wherein said plurality of arms formed with the members extending between the ends of said arms are in a hexagonal configuration; and, wherein, said plurality of cords form panels extending aft of said towing frame and terminate in a ring shaped member at the aft portion thereof.

10. The aerial gunnery target as claimed in claim 9 further comprising:

a bag for receiving said aerial gunnery target adapted to be placed in a container under an aircraft;

cord means for maintaining said bag in closed relationship until said deployment is desired and for securing said arms in their axial orientation with said pod; and, cutting means for cutting said cord to deploy said target.

11. The aerial gunnery target as claimed in claim 8 wherein:

said arms are pivotally mounted for movement from the axial relationship of said radar pod outwardly.

12. The aerial gunnery target as claimed in claim 1 wherein:

said towing frame is attached to a drone on either side thereof to give the appearance of an extended optical outline.

13. An improved aerial gunnery target for towing behind an aircraft comprising:

a pod having a radar scoring device therein adapted for attachment to a tow line being towed behind an aircraft;

a plurality of arms attached to said pod that are in hinged relationship to said pod and that can be deployed outwardly from an axial orientation with said pod to an open condition to form a structure extending from the axis of said pod;

means to stop said arms in their outward radial orientation from said axial orientation of said pod; and, a plurality of elongated fibrous members in the form of cords attached to said plurality of arms forming a target at towing speeds having a cross section substantially conforming to the structure to which they are attached.

14. The aerial gunnery target as claimed in claim 13 further comprising:

means to secure said cordsaft of said arms to form a unified body when said aerial gunnery target is being towed.

15. The aerial gunnery target as claimed in claim 14 further comprising:

support means extending between the arms; and, means to attach said cords to said support means extending between said arms to provide an aerial gunnery target having a three dimensional shape.

16. The aerial gunnery target as claimed in claim 15 further comprising:

securement means for holding said arms in axial relationship to said radar pod; and, means for releasing said securement means.

17. The aerial gunnery target as claimed in claim 16 wherein:

said means for holding said arms comprises:

cords; and, said release means comprise a cutting member.

18. The aerial gunnery target as claimed in claim 17 wherein:

said arms are pivotally mounted for movement from said axial relationship to deployed radial relationship with said pod; and, further comprising stop means for preventing the pivotal movement of said arms beyond the radial relationship established thereby when deployed.

19. The combination as claimed in claim 18 further comprising:

a bag for securing said aerial gunnery target; and, cord means for securing said bag around said aerial gunnery target; and, cutting means for releasing said cord means so said bag can be pulled from said aerial gunnery target.

20. The aerial gunnery target as claimed in claim 19 further comprising:

a pilot chute attached to said bag for causing said bag to deploy from said aircraft that it is being towed from.

* * * * *